US008740325B2

(12) United States Patent
Dahrea et al.

(10) Patent No.: US 8,740,325 B2
(45) Date of Patent: Jun. 3, 2014

(54) METHOD FOR PRINTING IN A PRINTER HAVING AN INOPERABLE INK RESERVOIR

(75) Inventors: Michael Joseph Dahrea, Rochester, NY (US); Michael William Elliot, Macedon, NY (US)

(73) Assignee: Xerox Corporation, Norwalk, CT (US)

( * ) Notice: Subject to any disclaimer, the term of this patent is extended or adjusted under 35 U.S.C. 154(b) by 454 days.

(21) Appl. No.: 12/966,058

(22) Filed: Dec. 13, 2010

(65) Prior Publication Data

US 2012/0147073 A1 Jun. 14, 2012

(51) Int. Cl.
*B41J 2/195* (2006.01)

(52) U.S. Cl.
USPC ..... 347/7; 347/5; 347/16

(58) Field of Classification Search
USPC ..... 347/5, 7, 9, 19, 16
See application file for complete search history.

(56) References Cited

U.S. PATENT DOCUMENTS 5,860,363 A 1/1999 Childers et al.
7,635,173 B2 * 12/2009 Lyman et al. ..... 347/7
7,942,488 B2 * 5/2011 Lang ..... 347/7
2002/0167572 A1 11/2002 Heim et al.
2005/0140705 A1 6/2005 Godil et al.
2006/0071954 A1 * 4/2006 Morooka et al. ..... 347/5
2008/0094430 A1 4/2008 Richards et al.
2009/0009573 A1 1/2009 Larson et al.
2009/0322806 A1 12/2009 Donahue et al.
2010/0259576 A1 10/2010 Mukaiyama

FOREIGN PATENT DOCUMENTS

JP 2007-57732 A 3/2007
JP 2009-119610 A 6/2009

OTHER PUBLICATIONS

Search Report of the United Kingdom Intellectual Property Office corresponding to Application No. GB1121166.1, UKIPO, South Wales, United Kingdom, Apr. 5, 2012 (4 pages).

* cited by examiner

*Primary Examiner* — Lam S Nguyen
(74) *Attorney, Agent, or Firm* — Maginot, Moore & Beck, LLP

(57) ABSTRACT

A method for operating a printer includes supplying liquid ink from two ink reservoirs to a printhead to enable the printhead to eject ink drops onto an image receiving substrate. A substrate transport moves the substrate past the printhead at a first speed. In response to detecting an interruption in the supply of liquid ink from one of the two ink reservoirs, the substrate transport moves the image receiving substrate at a slower second speed past the printhead.

14 Claims, 3 Drawing Sheets

METHOD FOR PRINTING IN A PRINTER HAVING AN INOPERABLE INK RESERVOIR

TECHNICAL FIELD

The present disclosure relates to ink-jet printing, and more particularly to inkjet printing directly on a media substrate.

BACKGROUND

Inkjet imaging devices eject liquid ink from printheads to form images on an image receiving member. The printheads include a plurality of inkjets that are arranged in some type of array. Each inkjet has a thermal or piezoelectric actuator that is coupled to a printhead controller. The printhead controller generates firing signals that correspond to digital data for images. The frequency and amplitude of the firing signals correspond to the selective activation of the printhead actuators. The printhead actuators respond to the firing signals by ejecting ink drops onto an image receiving member to form an ink image that corresponds to the digital image used to generate the firing signals.

Some embodiments of inkjet printers include printheads that receive ink for ejection onto a continuously moving image receiving substrate. One such inkjet printer is a continuous web printing device. In these systems, a continuous media substrate, such as a paper web, moves through a print zone where one or more printheads form ink images on the surface of the media substrate. In some embodiments, the media substrate may move through the print zone at a rate of several hundred feet per minute.

During operation, faults may develop in systems that supply ink to printheads in the printer. If one or more printheads do not receive a sufficient supply of ink, then the media substrate may pass the printheads without receiving a full ink image. The portion of the media substrate that is not fully imaged may have to be discarded. Previously known printers stop the media web when a fault in the ink supply is detected. Stopping the media web requires any faults in the ink supply to be corrected before imaging operations are able to resume. Resynchronizing the operation of the printing system to resume printing where the motion of the web was stopped may be difficult. Improvements in the operation of printers to address ink flow problems and web motion issues would be useful.

SUMMARY

In at least one embodiment, a method of operating a printer has been developed. The method includes supplying liquid ink from a first ink reservoir to a printhead to enable the printhead to eject ink drops onto an image receiving substrate, supplying liquid ink from a second ink reservoir to the printhead to enable the printhead to eject ink drops onto the image receiving substrate, operating a substrate transport to move the image receiving substrate at a first speed in a process direction past the printhead coupled to the first ink reservoir and the second ink reservoir, detecting an interruption in the supply of liquid ink from one of the first ink reservoir and the second reservoir to the printhead, and modifying operation of the substrate transport to move the image receiving substrate at a second speed in the process direction past the printhead coupled to the first ink reservoir and the second ink reservoir in response to the detection of the interruption of liquid ink being supplied from one of the first ink reservoir and second ink reservoir to the printhead. The second speed is lower than the first speed.

A printing apparatus has been developed. The printing apparatus includes a first ink reservoir, a first level sensor positioned within the first ink reservoir, a second ink reservoir, a second level sensor positioned within the second ink reservoir, a printhead fluidly coupled to the first ink reservoir and the second ink reservoir, a substrate transport, and a controller operatively connected to the substrate transport, the first level sensor, and the second level sensor. The first ink reservoir is configured to hold liquid ink. The first level sensor is configured to identify a level of liquid ink in the first ink reservoir. The second ink reservoir is configured to hold liquid ink. The second level sensor is configured to identify a level of liquid ink in the second ink reservoir. The printhead is configured to eject drops of ink received from the first ink reservoir and the second ink reservoir onto an image receiving substrate. The substrate transport is configured to move the image receiving substrate at a first speed in a process direction past the printhead that is fluidly coupled to the first ink reservoir and the second ink reservoir. The controller is configured to operate the substrate transport to move the image receiving substrate at a second speed in the process direction in response to the controller detecting an interruption in liquid ink being supplied from one of the first ink reservoir and the second ink reservoir to the printhead. The second speed is less than the first speed.

In at least another embodiment, a method of operating a printer has been developed. The method includes selectively supplying liquid ink from one of a first ink reservoir and a second ink reservoir to a printhead operatively connected to both the first ink reservoir and the second ink reservoir by at least one conduit, selectively coupling to a melting device the other of the first ink reservoir and the second ink reservoir not supplying liquid ink to the printhead to enable the other of the first ink reservoir and the second ink reservoir to receive liquid ink from the melting device while the one of the first ink reservoir and the second ink reservoir supplies liquid ink to the printhead, operating a substrate transport to move the image receiving substrate at a first speed in a process direction past the printhead being supplied by the one of the first ink reservoir and the second ink reservoir, detecting an interruption in the liquid ink being supplied from the one of the first ink reservoir and the second reservoir, and modifying operation of the substrate transport to move the image receiving substrate at a second speed in the process direction past the printhead in response to the detection of the interruption of liquid ink being supplied from the one of the first ink reservoir and second ink reservoir to the printhead, the second speed being lower than the first speed.

DETAILED DESCRIPTION

Figure 1:
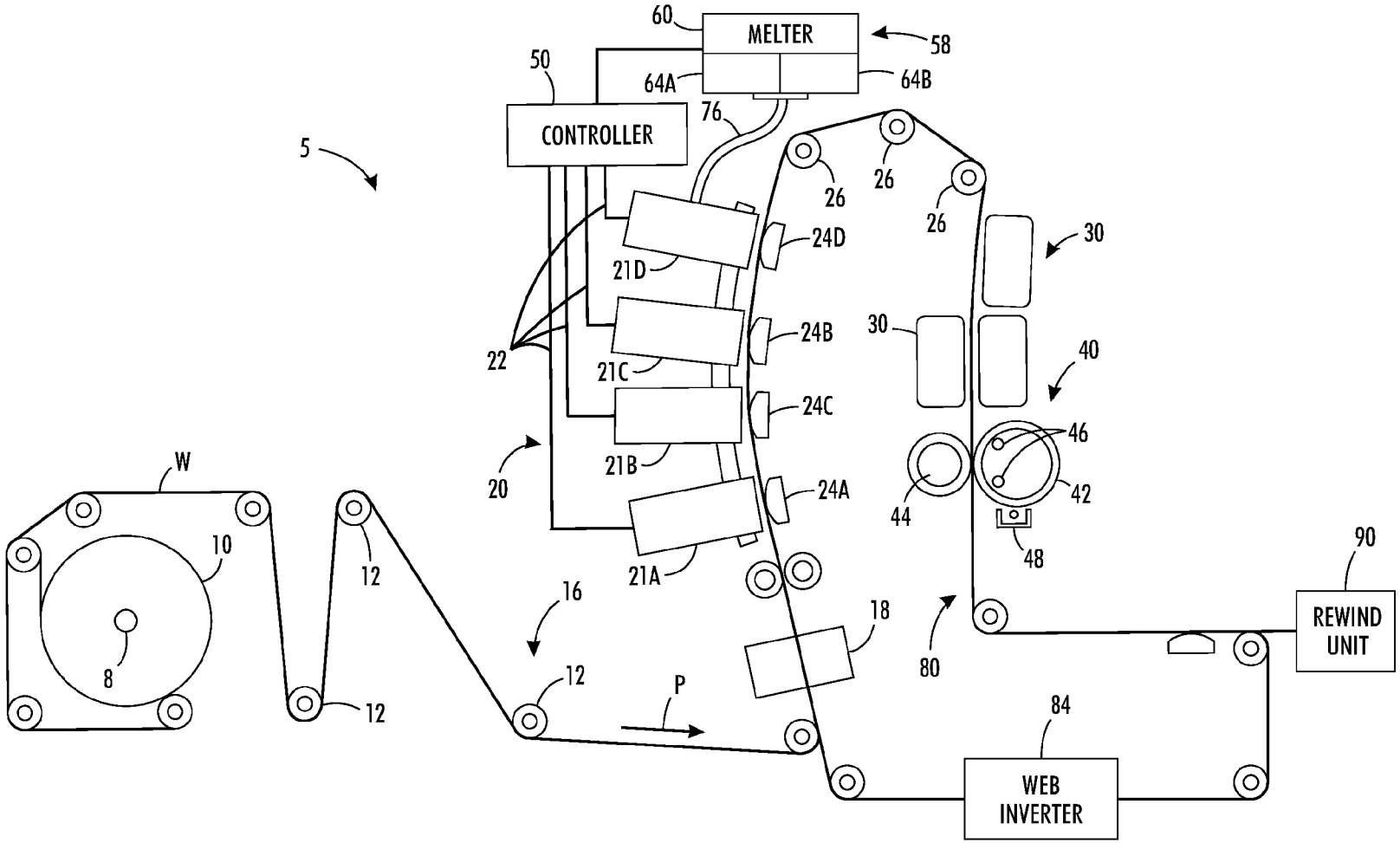
FIG. 1 is a schematic view of a continuous web printer.

For a general understanding of the environment for the system and method disclosed herein as well as the details for the system and method, reference is made to the drawings. In the drawings, like reference numerals have been used throughout to designate like elements. As used herein, the word "printer" encompasses any apparatus that performs a print outputting function for any purpose, such as a digital copier, bookmaking machine, facsimile machine, a multifunction machine, or the like. The term "image receiving member" encompasses any print medium including paper, as well as indirect imaging members including imaging drums or belts. The image receiving member travels in a process direction, with a cross-process direction being perpendicular to the process direction. A "media substrate" is a form of image receiving configured to receive printed ink images. Common forms of media substrates include cut sheets of a printable media or a member formed in a long (i.e., substantially continuous) web of a printable media such as paper.

Referring to FIG. 1, an inkjet imaging system 5 is shown that has been configured for operating in different modes when there is an interrupted ink flow to one or more printheads during printing operations. For the purposes of this disclosure, the imaging apparatus is in the form of an inkjet printer that employs one or more inkjet printheads and an associated solid ink supply. However, the methods described herein are applicable to any of a variety of other imaging apparatuses that use inkjet ejectors in printheads to form images.

The imaging system includes a print engine to process the image data before generating the control signals for the inkjet ejectors for ejecting colorants. Colorants may be ink, or any suitable substance that includes one or more dyes or pigments and that may be applied to the selected media. The colorant may be black, or any other desired color, and a given imaging apparatus may be capable of applying a plurality of distinct colorants to the media. The media may include any of a variety of substrates, including plain paper, coated paper, glossy paper, polymers such as plastic sheets, or transparencies, among others, and the media may be available in sheets, rolls, or another physical formats.

Direct-to-sheet, continuous-media, phase-change inkjet imaging system 5 includes a media supply and handling system configured to supply a long (i.e., substantially continuous) web of media W of "substrate" (paper, plastic, or other printable material) from a media source, such as spool of media 10 mounted on a web roller 8. For simplex printing, the printer is comprised of feed roller 8, media conditioner 16, printing station 20, printed web conditioner 80, and rewind unit 90. For duplex operations, the web inverter 84 is used to flip the web over to present a second side of the media to the printing station 20 and printed web conditioner 80 before being taken up by the rewind unit 90. Duplex operations may also be achieved with two printers arranged serially with a web inverter interposed between them. In this arrangement, the first printer forms and fixes an image on one side of a web, the inverter turns the web over, and the second printer forms and fixes an image on the second side of the web. In the simplex operation, the media source 10 has a width that substantially covers the width of the rollers over which the media travels through the printer. In duplex operation, the media source is approximately one-half of the roller widths as the web travels over one-half of the rollers in the printing station 20 and printed web conditioner 80 before being flipped by the inverter 84 and laterally displaced by a distance that enables the web to travel over the other half of the rollers opposite the printing station 20 and printed web conditioner 80 for the printing and conditioning, if necessary, of the reverse side of the web. The rewind unit 90 is configured to wind the web onto a roller for removal from the printer and subsequent processing.

The media may be unwound from the source 10 as needed and propelled by a variety of motors, not shown, that rotate one or more rollers in a media transport. The media conditioner includes rollers 12 and a pre-heater 18. The rollers 12 control the tension of the unwinding media as the media transport moves the media along a path through the printer. In alternative embodiments, the media substrate may be transported along the path in cut sheet form in which case the media supply and handling system may include any suitable device or structure that enables the transport of cut media sheets along a desired path through the printer. The pre-heater 18 brings the web to an initial predetermined temperature that is selected for desired image characteristics corresponding to the type of media being printed as well as the type, colors, and number of inks being used. The pre-heater 18 may use contact, radiant, conductive, or convective heat to bring the media to a target preheat temperature, which in one practical embodiment, is in a range of about 30° C. to about 70° C.

The media substrate is transported through a printing station 20 that includes a series of color modules or units 21A, 21B, 21C, and 21D, each color module effectively extends across the width of the media and is able to eject ink directly (i.e., without use of an intermediate or offset member) onto the moving media. Each of the color modules includes at least one printhead, and some modules may include a plurality of printheads configured to extend across the width of the moving media substrate. As is generally familiar, each of the printheads may eject a single color of ink, one for each of the colors typically used in color printing, namely, cyan, magenta, yellow, and black (CMYK). The controller 50 of the printer receives velocity data from encoders mounted proximately to rollers positioned on either side of the portion of the path opposite the four printheads to calculate the linear velocity and position of the web as the web moves past the printheads. The controller 50 uses these data to generate timing signals for actuating the inkjet ejectors in the printheads to enable the printheads to eject four colors of ink with appropriate timing and accuracy for registration of the differently color patterns to form color images on the media. The inkjet ejectors actuated by the firing signals corresponds to image data processed by the controller 50. The image data may be transmitted to the printer, generated by a scanner (not shown) that is a component of the printer, or otherwise generated and delivered to the printer. In various embodiments, a color module for each primary color may include one or more printheads; multiple printheads in a module may be formed into a single row or multiple row array; printheads of a multiple row array may be staggered; a printhead may print more than one color; or the printheads or portions thereof can be mounted movably in a direction transverse to the process direction P, also known as the cross-process direction, such as for spot-color applications and the like.

The printer may use "phase-change ink," by which is meant that the ink is substantially solid at room temperature and substantially liquid when heated to a phase change ink melting temperature for jetting onto the imaging receiving surface. The phase change ink melting temperature may be any temperature that is capable of melting solid phase change ink into liquid or molten form. In one embodiment, the phase change ink melting temperature is approximately 70° C. to 140° C. In alternative embodiments, the ink utilized in the printer may comprise UV curable gel ink. Gel ink may also be heated before being ejected by the inkjet ejectors of the printhead. As used herein, liquid ink refers to melted solid ink, heated gel ink, or other known forms of ink, such as aqueous inks, ink emulsions, ink suspensions, ink solutions, or the like.

Each printhead in one of the color modules 21A-21D is fluidly coupled to an ink supply system. For simplicity, FIG. 1 depicts a single ink supply system 58 that supplies ink to at least one printhead in the color module 21D, but each of color modules 21A-21D has at least one separate ink supply for supplying a different color of ink to at least one printhead in the color module to which the ink supply is fluidly connected. Ink supply system 58 is operatively connected to controller 50. Ink supply 58 includes a melter 60 and two ink reservoirs 64A and 64B that are selectively fluidly coupled to a printhead in a color module, such as color module 21D, through a conduit 76. A printhead in color module 21D receives ink under pressure from one of reservoirs 64A and 64B. Thus, one reservoir at a time is pressurized to provide ink, while the other reservoir is depressurized to receive ink from melter 60. Ink supply 58 is described in more detail below with reference to FIG. 2.

Associated with each color module is a backing member 24A-24D, typically in the form of a bar or roll, which is arranged substantially opposite the printhead on the back side of the media. Each backing member is used to position the media at a predetermined distance from the printhead opposite the backing member. Each backing member may be configured to emit thermal energy to heat the media to a predetermined temperature which, in one practical embodiment, is in a range of about 40° C. to about 60° C. The various backer members may be controlled individually or collectively. The pre-heater 18, the printheads, backing members 24 (if heated), as well as the surrounding air combine to maintain the media along the portion of the path opposite the printing station 20 in a predetermined temperature range of about 40° C. to 70° C.

As the partially-imaged media moves to receive inks of various colors from the printheads of the printing station 20, the temperature of the media is maintained within a given range. Ink is ejected from the printheads at a temperature typically significantly higher than the receiving media temperature. Consequently, the ink heats the media. Therefore other temperature regulating devices may be employed to maintain the media temperature within a predetermined range. For example, the air temperature and air flow rate behind and in front of the media may also impact the media temperature. Accordingly, air blowers or fans may be utilized to facilitate control of the media temperature. Thus, the media temperature is kept substantially uniform for the jetting of all inks from the printheads of the printing station 20. Temperature sensors (not shown) may be positioned along this portion of the media path to enable regulation of the media temperature. These temperature data may also be used by systems for measuring or inferring (from the image data, for example) how much ink of a given primary color from a printhead is being applied to the media at a given time.

Following the printing zone 20 along the media path are one or more "mid-heaters" 30. A mid-heater 30 may use contact, radiant, conductive, and/or convective heat to control a temperature of the media. The mid-heater 30 brings the ink placed on the media to a temperature suitable for desired properties when the ink on the media is sent through the spreader 40. In one embodiment, a useful range for a target temperature for the mid-heater is about 35° C. to about 80° C. The mid-heater 30 has the effect of equalizing the ink and substrate temperatures to within about 15° C. of each other. Lower ink temperature gives less line spread while higher ink temperature causes show-through (visibility of the image from the other side of the print). The mid-heater 30 adjusts substrate and ink temperatures to 0° C. to 20° C. above the temperature of the spreader.

Following the mid-heaters 30, a fixing assembly 40 is configured to apply heat and/or pressure to the media to fix the images to the media. The fixing assembly may include any suitable device or apparatus for fixing images to the media including heated or unheated pressure rollers, radiant heaters, heat lamps, and the like. In the embodiment of the FIG. 1, the fixing assembly includes a "spreader" 40, that applies a predetermined pressure, and in some implementations, heat, to the media. The function of the spreader 40 is to take what are essentially droplets, strings of droplets, or lines of ink on web W and smear them out by pressure and, in some systems, heat, so that spaces between adjacent drops are filled and image solids become uniform. In addition to spreading the ink, the spreader 40 may also improve image permanence by increasing ink layer cohesion and/or increasing the ink-web adhesion. The spreader 40 includes rollers, such as image-side roller 42 and pressure roller 44, to apply heat and pressure to the media. Either roll can include heat elements, such as heating elements 46, to bring the web W to a temperature in a range from about 35° C. to about 80° C. In alternative embodiments, the fixing assembly may be configured to spread the ink using non-contact heating (without pressure) of the media after the print zone. Such a non-contact fixing assembly may use any suitable type of heater to heat the media to a desired temperature, such as a radiant heater, UV heating lamps, and the like.

In one practical embodiment, the roller temperature in spreader 40 is maintained at a temperature to an optimum temperature that depends on the properties of the ink such as 55° C.; generally, a lower roller temperature gives less line spread while a higher temperature causes imperfections in the gloss. Roller temperatures that are too high may cause ink to offset to the roll. In one practical embodiment, the nip pressure is set in a range of about 500 to about 2000 psi lbs/side. Lower nip pressure gives less line spread while higher pressure may reduce pressure roller life.

The spreader 40 may also include a cleaning/oiling station 48 associated with image-side roller 42. The station 48 cleans and/or applies a layer of some release agent or other material to the roller surface. The release agent material may be an amino silicone oil having viscosity of about 10-200 centipoises. Only small amounts of oil are required and the oil carried by the media is only about 1-10 mg per A4 size sheet. In one possible embodiment, the mid-heater 30 and spreader 40 may be combined into a single unit, with their respective functions occurring relative to the same portion of media simultaneously. In another embodiment the media is maintained at a high temperature as it is printed to enable spreading of the ink.

Following passage through the spreader 40 the printed media may be wound onto a roller for removal from the system (simplex printing) or directed to the web inverter 84 for inversion and displacement to another section of the rollers for a second pass by the printheads, mid-heaters, and spreader. The duplex printed material may then be wound onto a roller for removal from the system by rewind unit 90. Alternatively, the media may be directed to other processing stations that perform tasks such as cutting, binding, collating, and/or stapling the media or the like.

Operation and control of the various subsystems, components and functions of the device 5 are performed with the aid of the controller 50. The controller 50 may be implemented with general or specialized programmable processors that execute programmed instructions. The instructions and data required to perform the programmed functions may be stored in memory associated with the processors or controllers. These components may be provided on a printed circuit card or provided as a circuit in an application specific integrated circuit (ASIC). Each of the circuits may be implemented with a separate processor or multiple circuits may be implemented on the same processor. Alternatively, the circuits may be implemented with discrete components or circuits provided in VLSI circuits. Also, the circuits described herein may be implemented with a combination of processors, ASICs, discrete components, or VLSI circuits. Controller 50 may be operatively connected to the printhead or printheads in each of color modules 21A-21D in order to adjust the operation of inkjet ejectors that eject ink drops onto the web W. Controller 50 is further configured to control the operation of ink supplies such as ink supply 58. When both reservoirs in the ink supply 58 are capable of supplying ink, controller 50 operates the ink supply 58 to enable a continuous flow of pressurized ink to the color module 21D while refilling a depressurized reservoir with liquid ink from melter 60. As described in more detail below, controller 50 may also operate the ink supply, color modules, and media transport in an alternative mode when one of the ink reservoirs 64A and 64B in ink supply 58 experiences an interruption in supplying ink.

Figure 2:
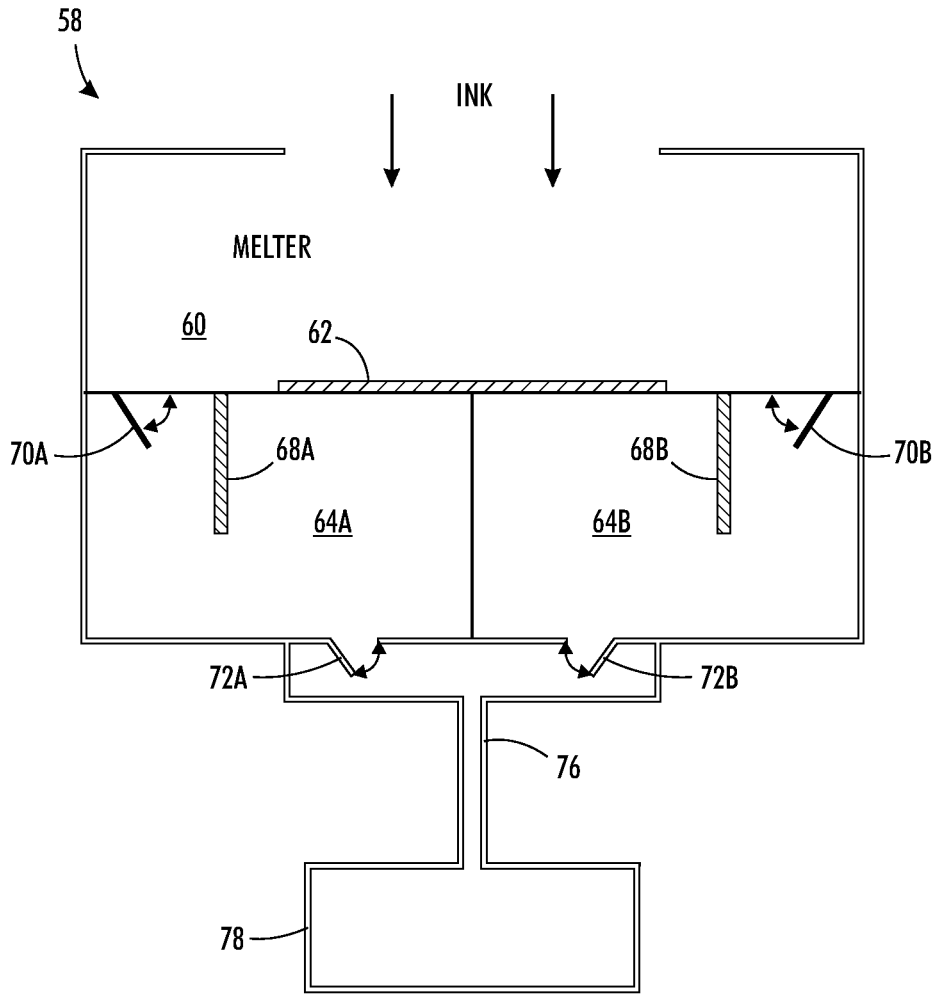
FIG. 2 is a schematic view of an ink supply assembly for supplying ink to one or more printheads.

FIG. 2 depicts ink supply system 58 in more detail. The ink supply 58 includes an ink melter 60, ink reservoirs 64A and 64B, and a fluid conduit 76 that enables ink to flow from the ink supply 58 to a printhead 78. Ink supply 58 is a dual-reservoir system since reservoirs 64A and 64B each maintain a separate supply of ink. Ink chamber 64A may be placed in selective fluid communication with the melter 60 through opening 70A and with the conduit 76 through opening 72A. Similarly, reservoir 64B is placed in selective fluid communication with melter 60 and conduit 76 through openings 70B and 72B, respectively. Each of the reservoirs 64A and 64B is configured to hold liquid ink, and each reservoir may include a heater (not shown) to maintain the ink in a liquid phase. Level sensors 68A and 68B are positioned within reservoirs 64A and 64B, respectively, and identify the level of ink present in each reservoir. Level sensors 68A and 68B may be coupled to a controller, such as controller 50 in FIG. 1, to enable the controller to operate the ink supply 58 with reference to the levels of ink in each reservoir. Level sensors 68A and 68B may be thermistors, or any other sensing device appropriate for identifying the level of ink in reservoirs 64A and 64B.

In operation, solid ink enters the melter 60. The solid ink may have various forms, such as ink sticks or ink pellets. A melting device, seen here as melt plate 62, applies sufficient heat to liquefy the solid ink in the melter. The liquefied ink may flow into ink reservoir 64A through opening 70A or ink reservoir 64B through opening 70B. During operation, one of the reservoirs 64A and 64B is pressurized and supplies ink to color module 21, while the other reservoir is depressurized to enable the reservoir to receive ink from the melter 60. The pressurized reservoir has either opening 70A or 70B sealed, while corresponding opening 72A or 72B is opened. An external pressure source (not shown) applies positive pressure to the reservoir to enable ink to flow to the printhead. The depressurized reservoir has a corresponding one of openings 70A and 70B opened to vent the depressurized reservoir to atmospheric pressure. The corresponding opening 72A or 72B in the depressurized reservoir is sealed. For example, if reservoir 64A is pressurized, opening 70A is closed and opening 72B is open to enable pressurized ink in reservoir 64 to flow through conduit 76 to printhead 78. In this configuration, reservoir 64B is vented through opening 70B to place reservoir 64B in fluid communication with melter 60. The melter 60 is unpressurized, and in this configuration reservoir 64B also depressurizes to enable ink to flow to the reservoir. Opening 72B is closed to maintain pressure in the conduit 76 while reservoir 64B receives ink from melter 60. Openings 70A, 70B, 72A, and 72B may be opened and closed using any appropriate sealing device including a servo activated stopping member or a valve. A controller, such as controller 50 in FIG. 1, may selectively open and close the openings 70A, 70B, 72A, and 72B in operation.

During printing operations, the pressurized one of ink reservoirs 64A and 64B provides ink to the printhead until the level of ink drops below a predetermined level measured by one of level sensors 68A and 68B. In response to detecting the low ink level, the depressurized ink reservoir that holds ink received from the melter is sealed off from the melter, pressurized, and placed in fluid communication with the conduit 76. The pressurized ink reservoir is sealed off from the conduit, depressurized, and placed in fluid communication with the melter 60 to receive ink. Each reservoir may either supply ink to the printhead or receive ink from melter 60 as needed during printing operations. Thus, ink supply 58 provides a constant supply of pressurized ink to the printhead 78. Alternative embodiments of ink supply 58 may be configured to supply ink to two conduits where each conduit is placed in fluid communication with one of the reservoirs 64A and 64B.

During operation, various faults may occur that render a reservoir inoperable by interrupting the flow of ink from one of the ink reservoirs 64A and 64B to the printhead 78. For example, debris or other contaminants may enter ink melter 60 and block the flow of ink through one of the reservoirs 64A and 64B. If one of the reservoir heaters fails, ink may solidify in the reservoir and interrupt a flow of ink from through the reservoir to the printhead 78. Additionally, if one of the ink level sensors 68A and 68B develops a fault, the controller may unable to measure a level of ink in the reservoir with the faulty level sensor. In another failure mode, both ink reservoirs may supply ink at rate where the printhead or printheads receiving ink from the reservoirs consume the ink at a faster rate than the reservoirs receive ink from the melter. In these conditions, an interruption in the ink supply 58 occurs when one of reservoirs 64A and 64B is still filling with ink while the other reservoir is unable to supply ink. In any condition where ink supply 58 experiences an interruption with one ink reservoir, the ink supply 58 and printer may continue to operate using one or more alternative printing modes. These modes enable the printer to continue operating until both ink reservoirs can provide an uninterrupted supply of ink to the printheads.

Figure 3:
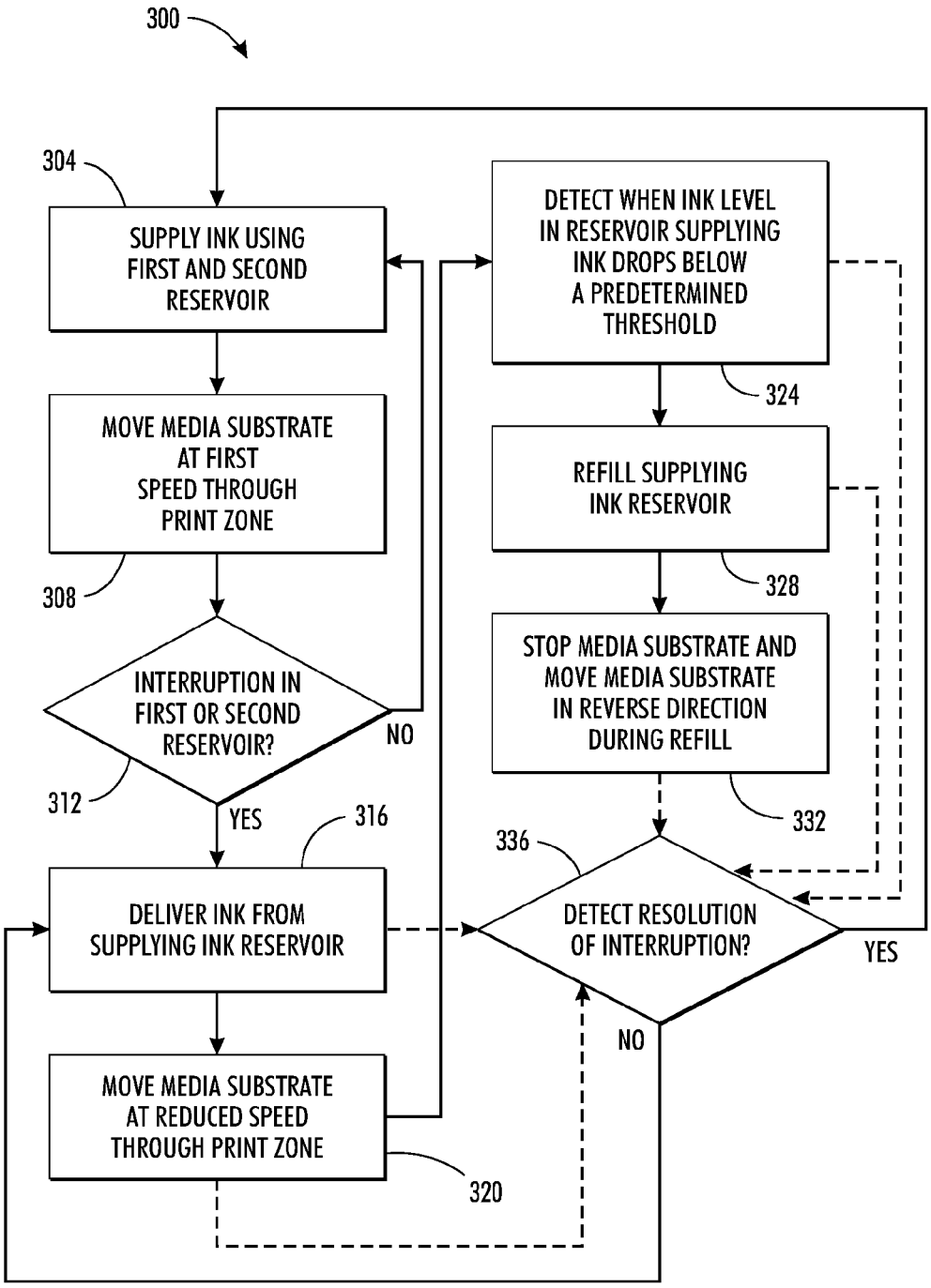
FIG. 3 is a block diagram of a method for operating a printer when a flow of ink through one ink reservoir in a dual-reservoir assembly is interrupted.

FIG. 3 depicts a block diagram of a process 300 for detecting an interruption in the supply of liquid ink from an ink reservoir and operating a printer in an alternative printing mode in response to detection of the interruption. The operation of the media transport, valves, and pressure sources as well as the printheads may be performed by the controller 50 or another controller or control circuit that is operatively connected to the controller. Controller 50 and any other control circuits required to perform one or more actions implemented by process 300 are configured using hardware, software, or a combination of hardware and software. Process 300 begins by supplying ink to both ink reservoirs in a dual-reservoir ink supply system, such as system 58 shown in FIG. 1 and FIG. 2 (block 304). As described above, one reservoir is pressurized and provides ink to the printhead, while the other reservoir is depressurized and receives melted ink, and the reservoirs switch between supplying ink to the printhead and receiving ink from the melt assembly to provide a continuous supply of ink to the printheads. The printer moves a media substrate, such as a continuous web, through the print zone at a first speed for imaging operations (block 308). The first speed for moving the media substrate may be a standard operating speed for the printer, with various printer designs and operating modes being configured to move the media substrate at different speeds in the process direction.

Process 300 supplies ink using the double-reservoir ink supplies and moves the media at the first speed for imaging operations when no interruptions are detected in the first and second reservoirs of each ink supply (block 312). Process 300 may detect an interruption occurring in one of the first and second ink reservoirs in an ink supply (block 312). Various methods of detecting an interruption may be used for detecting the interruption. The level sensors in the ink reservoirs may detect blockages in one of the reservoirs when the level of ink in a pressurized ink reservoir does not decrease during printing operations. Another method for detecting interruptions includes measuring the volumetric rate at which ink flows into a depressurized reservoir. If the rate at which the ink flows into the depressurized reservoir is below an expected rate, this anomalous rate may indicate an interruption in the flow of ink through the reservoir for use in the printer. Faults identified in the operation of a level sensor in a reservoir may also interrupt the flow of ink through the reservoir.

In response to detecting an interruption in the operation of a reservoir in an ink supply, process 300 begins supplying ink from the ink reservoir that has not experienced an interruption (block 316). When an interruption is detected in the supply of ink from one reservoir, process 300 reduces the speed at which the media substrate moves through the print zone compared to the operational speed when there is no detected interruption in the ink supply (block 320). Printing operations continue at the reduced operating speed until the detected level of ink in the reservoir delivering ink drops below a predetermined threshold (block 324), and the printer depressurizes the supplying ink reservoir and refills it with ink (block 328). Moving the media substrate at a lower speed in the process direction reduces the rate of ink consumption from the supplying reservoir. In situations where the interruption is due to the rate of printhead ink consumption exceeding the fill rate for the reservoirs, the lower media substrate speed may enable both reservoirs to supply ink and be refilled in an appropriate manner to provide a continuous supply of ink to the printheads.

In situations where one reservoir is blocked or otherwise unable to provide ink to the printheads, the supplying reservoir provides ink until the refill operation depressurizes the printhead. Printing operations that eject ink using the printhead or printheads coupled to the ink reservoir are suspended until the reservoir is refilled and pressurized. Thus, shortening the refill process increases the efficiency of operating the printer with one supplying reservoir. The non-pressurized ink melter may be configured to melt and retain a supply of liquid ink while the supplying reservoir continues to deliver ink for printing. Upon venting the supplying reservoir to the ink melter, the retained liquid ink in the melter may flow directly into the reservoir to increase the refill rate of the reservoir.

During the refill operation, some web printer embodiments may continue to move the media substrate through the print zone at the reduced speed. The reduced speed of the media substrate is selected to enable printing operations to continue using the supplying reservoir, while reducing the amount of media that passes through the print zone during the refill operation of the supplying reservoir. The magnitude of speed reduction may be selected according to operating parameters to balance throughput and media usage. For example, in a maximum throughput mode the media web may move at the normal speed while the supplying reservoir is printing and then while the reservoir is refilled. In another mode selected to reduce media web usage, a lower media substrate speed reduces the length of the media substrate that passes through the print zone as the ink reservoir is refilled.

Process 300 may stop the movement of the media substrate and move the media substrate in a reverse direction by a predetermined distance during the refill operation of the ink reservoir (block 332). During printing operations the media substrate moves in the process direction through the print zone, and the media substrate moves in the reverse of the process direction while the reservoir is refilled. This operation enables at least a portion of the media substrate that would otherwise pass through the print zone without receiving an ink image to be imaged after the supplying ink reservoir is refilled. The reduced operating speed used to transport the media web through the print zone in the process direction facilitates stopping and moving the media web in the reverse direction while the ink reservoir refills. The media substrate may move various distances in the reverse process direction based on the print mode, including moving already imaged areas of the media substrate through the print zone to account for the distance needed to accelerate the media web to an operating speed in the process direction when printing operations resume. Stopping and reversing the movement of the media substrate is an optional process, and printer embodiments that lack the ability to reverse the direction of the media substrate may still move the media substrate at the reduced speed described above.

Process 300 may detect when an interruption has been resolved (block 336) and subsequently supply ink to both ink reservoirs and print to the media substrate at full speed (blocks 304 and 308). In the event that the interruption continues (block 336), process 300 continues to print using ink delivered from the supplying ink reservoir as described above. Process 300 may detect that an interruption to ink flow from a reservoir has been resolved at any point after detecting that the interruption has occurred. In some embodiments, an operator may perform maintenance and signal that the interruption has been resolved. In other embodiments, sensors such as ink flow and ink level sensors may indicate that the interrupted reservoir is capable of resuming delivery of ink to the printhead. The resolution of the interruption in the ink supply may occur at any point in process 300 after the interruption is detected, as indicated by dashed lines between each of blocks 316-332 and block 336 in FIG. 3.

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed:

1. A method of operating a printing device comprising:

supplying liquid ink from a first ink reservoir to a printhead to enable the printhead to eject ink drops onto an image receiving substrate;

supplying liquid ink from a second ink reservoir to the printhead to enable the printhead to eject ink drops onto the image receiving substrate, the first and the second ink reservoirs each maintaining a supply of ink that is separate from a supply of ink in the other reservoir;

operating a substrate transport to move the image receiving substrate at a first speed in a process direction past the printhead coupled to the first ink reservoir and the second ink reservoir;

detecting an interruption in the supply of liquid ink from one of the first ink reservoir and the second reservoir to the printhead; and modifying operation of the substrate transport to move the image receiving substrate at a second speed in the process direction past the printhead coupled to the first ink reservoir and the second ink reservoir in response to the detection of the interruption of liquid ink being supplied from one of the first ink reservoir and second ink reservoir to the printhead, the second speed being lower than the first speed.

2. The method of claim 1, the detection of the interruption of liquid ink being supplied to the printhead from one of the first reservoir and the second reservoir further comprising:

detecting an ink level in one of the first ink reservoir and the second ink reservoir falling below a predetermined ink level threshold while an ink level in the other of the first ink reservoir and the second ink reservoir remains at or above the predetermined threshold.

3. The method of claim 1, the modification of the substrate transport operation further comprising:

stopping movement of the image receiving substrate in the process direction in response to the detection of the interruption of liquid ink being supplied from one of the first ink reservoir and the second ink reservoir to the printhead;

reversing the image receiving substrate by a distance that corresponds to a time interval between the detection of the interruption of liquid ink and the image receiving substrate coming to a stop; and resuming movement of the image receiving member in the process direction in response to termination of the interruption of liquid ink being supplied from one of the first ink reservoir and the second ink reservoir to the printhead.

4. The method of claim 1 further comprising:

supplying ink to the one of the first and second ink reservoirs from which the liquid ink supply has been detected as being interrupted.

5. The method of claim 4 further comprising:

coupling the one of the first ink reservoir and the second ink reservoir from which the liquid ink supply was detected as being interrupted to a melting device to enable the one of the first ink reservoir and the second ink reservoir from which the liquid ink supply was detected as being interrupted to receive liquid ink from the melting device in response to the detection of the interruption of the liquid ink supply from the one of the first ink reservoir and the second ink reservoir.

6. The method of claim 5 further comprising:

venting to atmospheric pressure the one of the first ink reservoir and the second ink reservoir from which the liquid ink supply was detected as being interrupted to facilitate liquid ink flowing from the melting device into the one of the first ink reservoir and the second ink reservoir from which the liquid ink supply was detected as being interrupted; and pressurizing the one of the first ink reservoir and the second ink reservoir from which the liquid ink supply was detected as being interrupted after the liquid ink has been received from the melting device.

7. The method of claim 1, the detection of the interruption of liquid ink being supplied to the printhead further comprising:

detecting a reduction in a predetermined volumetric rate at which liquid ink is supplied to one of the first and second ink reservoirs; and modifying operation of the substrate transport to move the image receiving substrate at the second speed in response to the detection in the reduction of the volumetric rate at which liquid ink is being supplied to the one of the first and the second ink reservoirs.

8. A printing apparatus, comprising:

a first ink reservoir, the first ink reservoir being configured to hold liquid ink;

a first level sensor positioned within the first ink reservoir, the level sensor being configured to identify a level of liquid ink in the first ink reservoir;

a second ink reservoir, the second ink reservoir being configured to hold liquid ink, the first and the second ink reservoirs each maintaining a supply of ink that is separate from a supply of ink in the other reservoir;

a second level sensor positioned within the second ink reservoir, the level sensor being configured to identify a level of liquid ink in the second ink reservoir;

a printhead fluidly coupled to the first ink reservoir and the second ink reservoir, the printhead being configured to eject drops of ink received from the first ink reservoir and the second ink reservoir onto an image receiving substrate;

a substrate transport, the substrate transport being configured to move the image receiving substrate at a first speed in a process direction past the printhead that is fluidly coupled to the first ink reservoir and the second ink reservoir; and a controller operatively connected to the substrate transport, the first level sensor, and the second level sensor, the controller being configured to operate the substrate transport to move the image receiving substrate at a second speed in the process direction in response to the controller detecting an interruption in liquid ink being supplied from one of the first ink reservoir and the second ink reservoir to the printhead, the second speed being less than the first speed.

9. The printing apparatus of claim 8, the controller being further configured to receive a signal from the first level sensor and the second level sensor to detect an ink level in the first ink reservoir and an ink level in the second ink reservoir, to compare the ink level in the first ink reservoir to a first ink level threshold and the ink level in the second ink reservoir to a second ink level threshold, and to detect the interruption of liquid ink being supplied to the printhead in response to one of the ink levels being below the predetermined ink level threshold to which the ink level was compared while the other ink level is at or above the predetermined ink level threshold to which the other ink level was compared.

10. The printing apparatus of claim 8, the controller being further configured to operate the substrate transport to stop movement of the image receiving substrate in the process direction in response to the detection of the interruption of liquid ink being supplied from one of the first ink reservoir and the second ink reservoir to the printhead, to reverse the image receiving substrate by a distance that corresponds to a time interval between the detection of the interruption of liquid ink and the image receiving substrate coming to a stop, and to resume movement of the image receiving member in the process direction in response to termination of the interruption of liquid ink being supplied from one of the first ink reservoir and the second ink reservoir to the printhead.

11. The printing apparatus of claim 8, the controller being further configured to enable liquid ink to be supplied to the one of the first and second ink reservoirs from which the liquid ink supply has been detected as being interrupted.

12. The printing apparatus of claim 11, the controller being further configured to couple the one of the first ink reservoir and the second ink reservoir from which the liquid ink supply was detected as being interrupted to a melting device to enable the one of the first ink reservoir and the second ink reservoir from which the liquid ink supply was detected as being interrupted to receive liquid ink from the melting device in response to the detection of the interruption of the liquid ink supply from the one of the first ink reservoir and the second ink reservoir.

13. The printing apparatus of claim 12, the controller being further configured to vent to atmospheric pressure the one of the first ink reservoir and the second ink reservoir from which the liquid ink supply was detected as being interrupted to facilitate liquid ink flowing from the melting device into the one of the first ink reservoir and the second ink reservoir from which the liquid ink supply was detected as being interrupted, and to activate a pressure source to pressurize the one of the first ink reservoir and the second ink reservoir from which the liquid ink supply was detected as being interrupted after the liquid ink has been received from the melting device.

14. The printing apparatus of claim 8, the controller being further configured to detect a reduction in a predetermined volumetric rate at which liquid ink is supplied to one of the first and second ink reservoirs to detect the interruption of liquid ink from one of the first ink reservoir and the second ink reservoir, and to modify operation of the substrate transport to move the image receiving substrate at the second speed in response to the detection in the reduction of the volumetric rate at which liquid ink is being supplied to the one of the first and the second ink reservoirs.

* * * * *